United States Patent [19]

Barber

[11] Patent Number: 4,600,252

[45] Date of Patent: Jul. 15, 1986

[54] MODULAR METAL CABINET

[76] Inventor: Steven C. Barber, 18900 Highland Ave., Deephaven, Minn. 55391

[21] Appl. No.: 582,899

[22] Filed: Feb. 23, 1984

[51] Int. Cl.[4] ..... A47B 87/00

[52] U.S. Cl. ..... 312/263; 312/108; 312/257 SM

[58] Field of Search ..... 312/108, 257 R, 257 SK, 312/257 SM, 263, 107

[56] References Cited

U.S. PATENT DOCUMENTS

| | | | |
|---|---|---|---|
| 1,450,180 | 4/1923 | Jamison | 312/257 R |
| 2,039,614 | 5/1936 | Tinnerman | 312/257 R |
| 3,087,768 | 4/1963 | Anderson et al. | 312/263 |
| 3,307,894 | 3/1967 | Collier | 52/281 |
| 4,309,365 | 1/1982 | Van Ness et al. | 312/263 |
| 4,470,647 | 9/1984 | Bishoff et al. | 312/108 |

*Primary Examiner*—William E. Lyddane
*Assistant Examiner*—Joseph Falk
*Attorney, Agent, or Firm*—James V. Harmon

[57] ABSTRACT

A modular metal cabinet is described which includes vertical interchangeable support columns formed from sheet metal and having a pair of web portions at right angles to each other. A plurality of interchangeable hollow reinforcing box panels also formed from sheet metal are secured to the web portions of the columns by fasteners hidden within the box panels. Each box panel is composed of the central rectangular wall sections, parallel top and bottom walls, parallel side walls with coplanar tabs extending toward one another from the edges of the side panels and positioned in overlapping face-to-face relationship with the webs of the columns. The fasteners extend through the webs into the tabs to hold the panels in place.

4 Claims, 14 Drawing Figures

MODULAR METAL CABINET

FIELD OF THE INVENTION

The present invention relates to furniture and more particularly to modular metal cabinets.

BACKGROUND OF THE INVENTION

Furniture construction has been developed in which provision is made for assembly of prefinished panels and shelves to provide finished furniture units of various sizes. However, prior modular cabinets have not always been easily assembled or disassembled, nor does the construction promote the simple selective arrangement or rearrangement of parts of the furniture in different relationships. In addition, the known techniques often use a variety of different fasteners or require a high degree of skill and understanding for successful assembly. Some involve the use of heavy castings or special fittings in addition to the structural members. These fittings add to the complexity and expense of the finished unit. In addition, assembly may involve permanent deformation of the panels and other furniture components so that the unit cannot be disassembled and reassembled. Others may provide only limited opportunity for shelf arrangement or overall size of the finished unit. Many prior cabinets of the type described cannot be completely assembled using only bolts or screws of simple construction. Another problem is that the wall panels add little strength or rigidity to the finished unit and provide little aesthetic appeal. A further problem is that in some prior cabinets several different structural elements such as binders, braces and panels are used to secure the posts together. This adds to the complexity of the finished product.

SUMMARY OF THE INVENTION

It is an object of the invention to provide a cabinet and cabinet assembly technique in which sheet metal panels and columns are used to provide a secure, strong and rigid cabinet that includes a plurality of fastening elements which are totally hidden within the panels and wherein the finished cabinet is composed of a plurality of identical and interchangable column members, and several identical and interchangable rigidifying box panels. The fastening elements can be of simple construction and do not cause deformation of the panels or other structural elements of the cabinet so that the components can be assembled in various relationships and then, if desired, disassembled. This construction will accommodate selective rearrangement of the columns and the panels to provide finished cabinets of different shapes and sizes.

Figure 1:
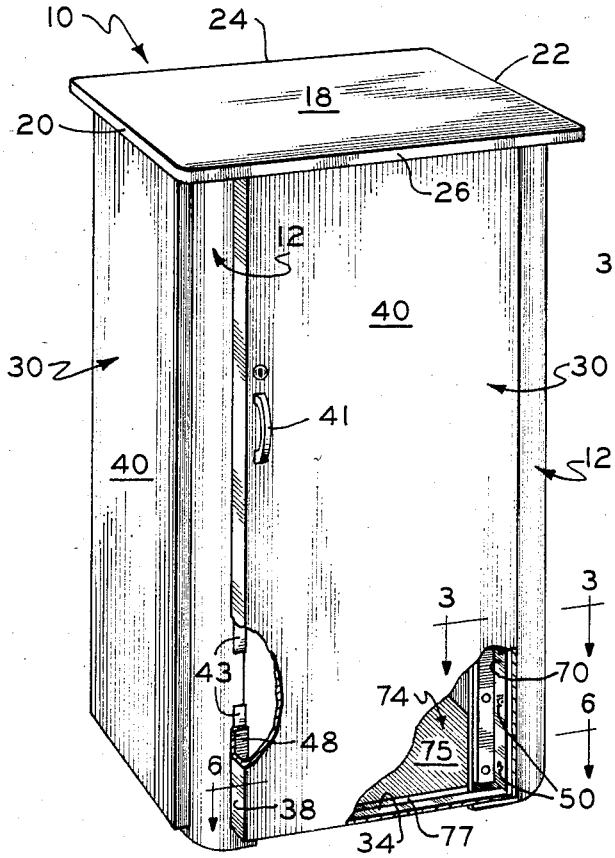
FIG. 1 is a perspective view of a cabinet in accordance with the invention.
Figure 2:
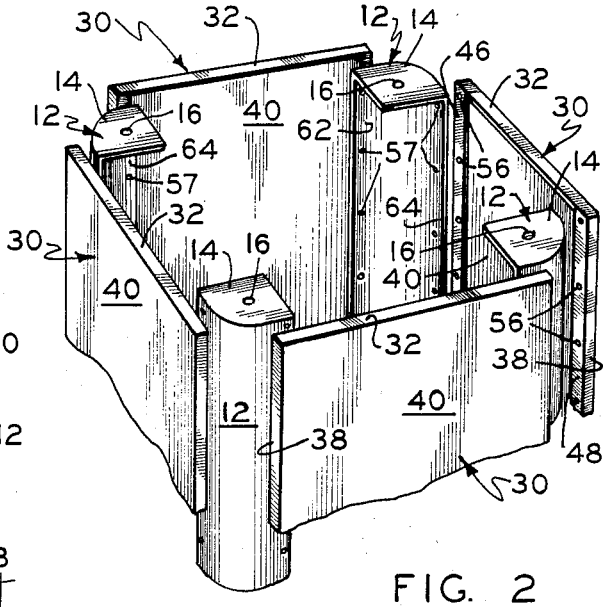
FIG. 2 is an exploded view of the upper portion of the cabinet of FIG. 1 with the top removed.

Refer now to FIGS. 1–7. As seen particularly in FIGS. 1 and 2, the cabinet 10 includes a plurality of vertically disposed, laterally spaced apart corner columns 12 each of which has a mounting plate 14 rigidly secured to its upper end by welding. The mounting plates 14 are coplanar after the columns have been erected and serve as a means for mounting the cabinet top 18. This can be accomplished by providing an opening 16 through the mounting plates 14 to accommodate a suitable fastener such as a screw or bolt (not shown). The cabinet top 18 can be formed from any suitable materials but is preferably formed from metal plate having parallel side edges 20, 22 and parallel back and front edges 24 and 26, respectively. Cabinet 18 is especially well-suited as a mounting plate or base for machine shop equipment, power tools and the like. The cabinet can be used and is especially well-designed for supporting machine tools such as hydraulic punches, drill presses, shears, punch presses and similar equipment. For such applications, the top 18 is preferably formed from a heavy metal plate of from about $\frac{3}{8}''$ to $\frac{1}{2}''$ thickness.

Connected between the corner columns 12 are four box panels 30 of rectangular shape each formed from sheet metal and composed of a central panel section 40 of rectangular shape with a horizontally extending, centrally projecting top and bottom flanges 32 and 34, vertically disposed, laterally spaced apart centrally extending side flanges 36 and 38, the latter two of which have tabs 46 and 48 projecting toward one another from the inner edges of the side flanges 36 and 38. The upper and lower edges of the side flanges and tabs are preferably welded to the adjacent edges of the top and bottom flanges 32 and 34 as shown at 39 in FIG. 4. This provides a rigid structure capable of withstanding the stresses involved in supporting heavy machinery. It will be seen that the flanges and tabs define walls for the panel which, in effect, give it a box-like configuration and it is the box-like configuration of the panels 30 that provide the stiffness, rigidity and resistance to deflection that has been found so important in providing the requisite structural strength for supporting heavy machine tools.

It will be seen in FIG. 1 that the panel 30 closest to the observer includes a handle 41. A hinge 70 is connected between its right edge and the adjacent column 12. In this way the panel at the front of the cabinet acts as a door. It is, however, identical to the panels 30 at the side and rear of the cabinet. In this way, the panels can be used interchangably to function either as a hinged door or as a stationary wall panel. Between the tab 48 at the left side edge of the front panel 30 is bonded a strip 43 of magnetic material such as a magentized rubber strip to hold the door in a normally closed position through magnetic attraction to the adjacent web portion of the column 12 beneath it.

Figure 3:
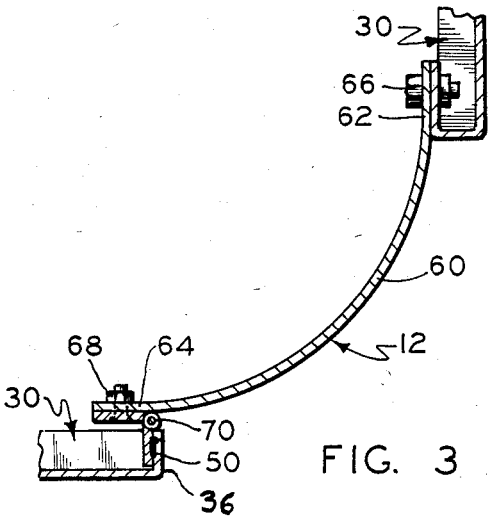
FIG. 3 is a vertical sectional view taken on line 3—3 of FIG. 1 on an enlarged scale.
Figure 4:
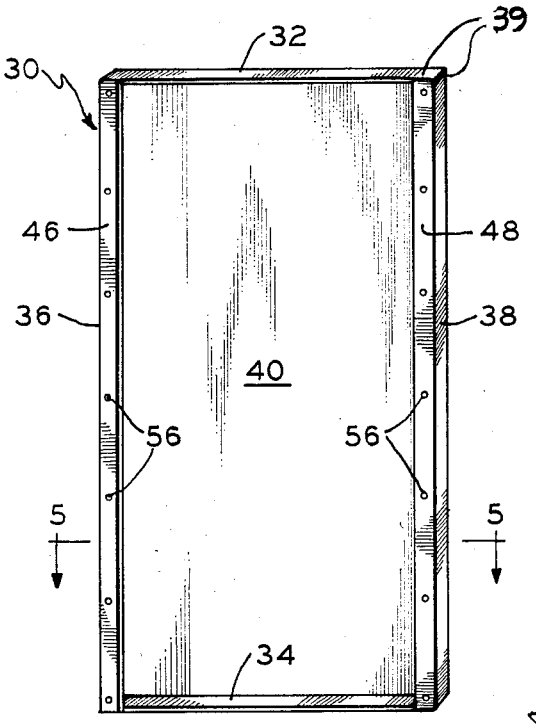
FIG. 4 is an inside perspective view of one of the modular wall panels.
Figure 5:
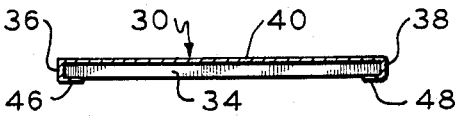
FIG. 5 is a horizontal sectional view taken on line 5—5 of FIG. 4.
Figure 6:
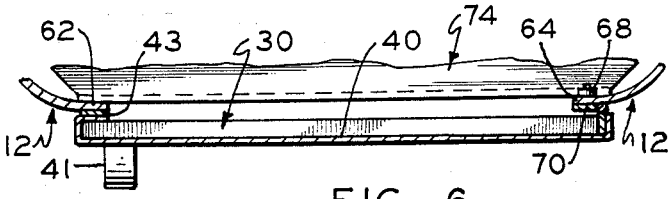
FIG. 6 is a horizontal sectional view taken on line 6—6 of FIG. 1.

In FIGS. 3 and 6 it will be seen that the corner column includes a pair of vertically disposed web sections 62 and 64 positioned at right angles to one another and connected together by means of an arcuate quarter-round section 60. The columns 12 are preferably formed from sheet metal appropriately bent with the mounting plates 14 welded to their ends. Connected between the panel 30 at the top of FIG. 3 and the adjacent underlying portion of the web 62 are a plurality of vertically spaced apart aligned fasteners 66 such as any suitable bolt, screw or other inexpensive removable fastener. In a similar manner, a hinge 70 is connected to the web 64 by means of several threaded fasteners 68. The hinge is welded to the wall 36 by means of a plurality of vertically spaced apart spot welds 50 which are also shown in FIG. 1. It will be noted that the fasteners 66 and 68 are hidden within the panels 30 and cannot be seen from the exterior of the cabinet. To accommodate the fasteners 66 and 68, a plurality of aligned, vertically disposed bored openings 56 are provided in the tabs 46 and 48 and are positioned to overlap corresponding openings 57 in the adjacent underlying web portions of the columns 12. In this way the panels 30 are interchangable between the columns 12 so that at least four interchangable upright support columns are provided in each cabinet, the columns being connected together by identical and interchangable box panels. The box structure of the panel strengthens the cabinet against bending, deflection, twisting and other stresses thereby strengthening and rigidifying the cabinet.

Figure 7:
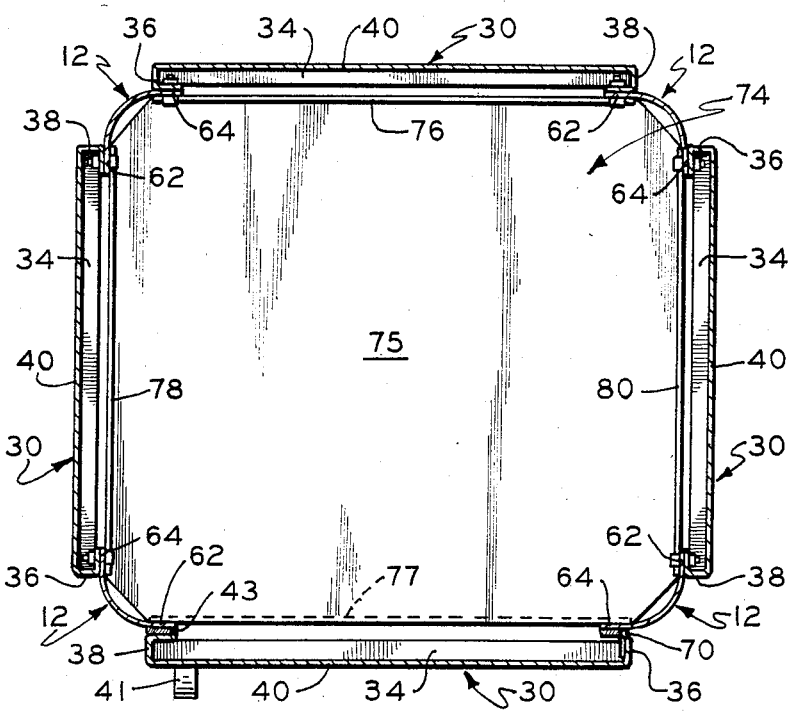
FIG. 7 is a central transverse sectional view of a cabinet in accordance with the invention.

Referring to FIG. 7, it will be seen that four panels 30 are provided to define the walls of the cabinet with four columns 12 connected between them. The outward projection of the panels beyond the plane of the quarter-round columns helps to protect the columns against damage and abrasion. If one of the panels is damaged, it can be easily replaced. Connected between the columns by means of fasteners 62, 64 is a shelf 75 having a rear flange 76 that extends upwardly therefrom and a pair of upwardly extending side flanges 78 and 80 that project upwardly from the side edges of the shelf. A downwardly deflected flange 77 is provided along the front edge of the shelf. These flanges along the edges of the shelves 75 are suitably bored at their ends to receive the fasteners 62, 64 thereby securing the shelves in place within the cabinet by fastening them to the columns 12.

Figure 8:
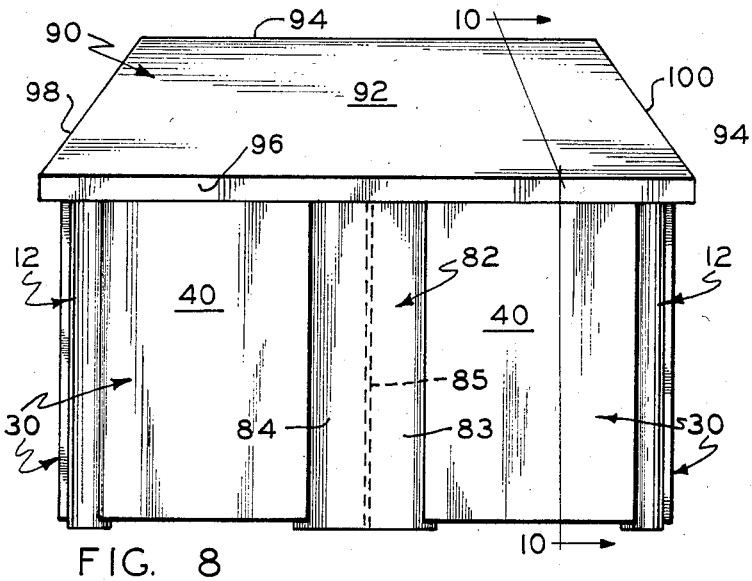
FIG. 8 is a perspective view of another embodiment of the invention.

Refer now to FIGS. 8–11 which illustrate a larger size cabinet formed from the same interchangable components already described. As seen in the Figures, a cabinet 90 is provided that includes two coplanar front panels 30 of the construction already described and positioned in side-by-side alignment as well as a pair of coplanar side-by-side rear panels 30 (FIG. 9 and 11) which together make up the rear wall of the cabinet 90. The front and rear panels of the cabinet 90 are connected by means of a different kind of column than already described. This column is designated 82 in the figures and comprises a flat center section composed of coplanar webs 83 and 84 with a centrally extending, perpendicularly disposed web 85 between them to provide a T-shaped cross section. To the upper end of the column 82 is welded a pair of flat horizontally disposed mounting plates 86 to which the cabinet top 92 is secured in any suitable manner. The cabinet top 92 as shown in FIG. 8 includes parallel rear and front edges 94 and 96 and a pair of parallel side edges 98 and 100.

Figure 10:
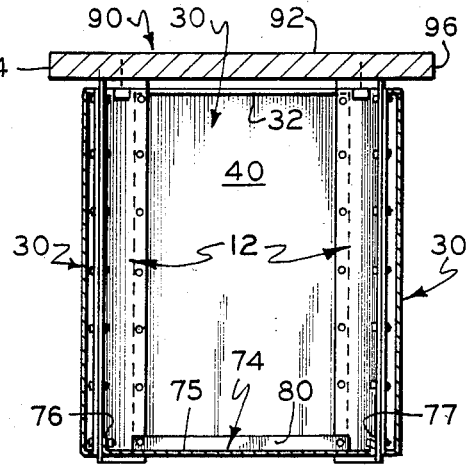
FIG. 10 is a vertical sectional view taken on line 10—10 of FIG. 8.
Figure 9:
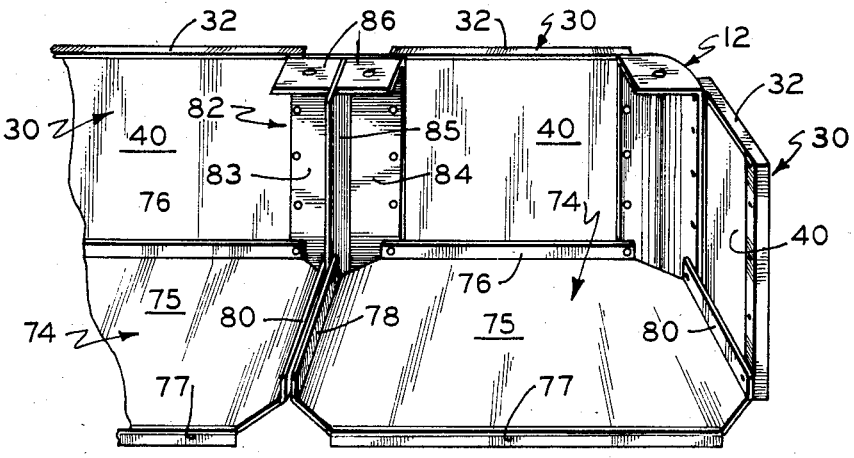
FIG. 9 is a partial perspective view of the upper portion of the cabinet of FIG. 8 with the top and front panels removed.
Figure 11:
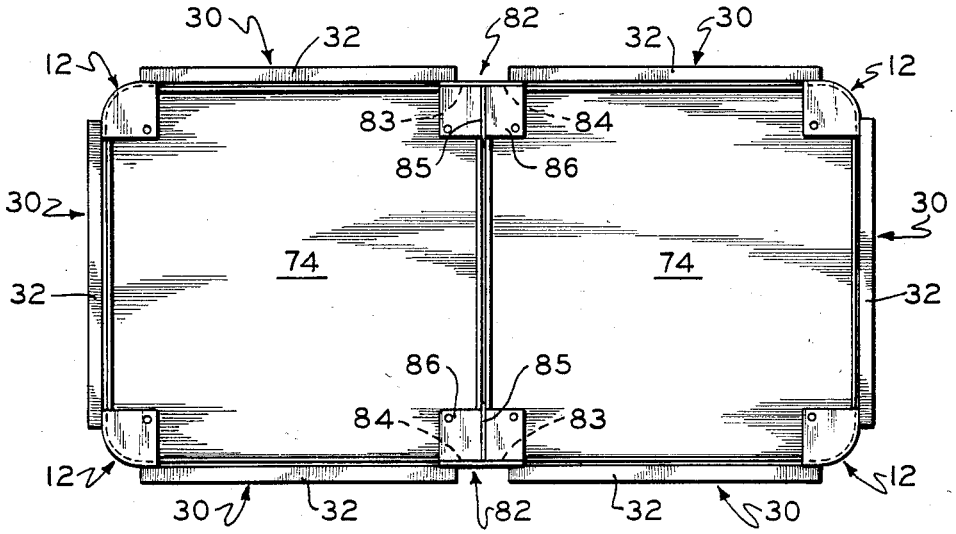
FIG. 11 is a top view of the cabinet of FIG. 8 with the top removed.
Figure 12:
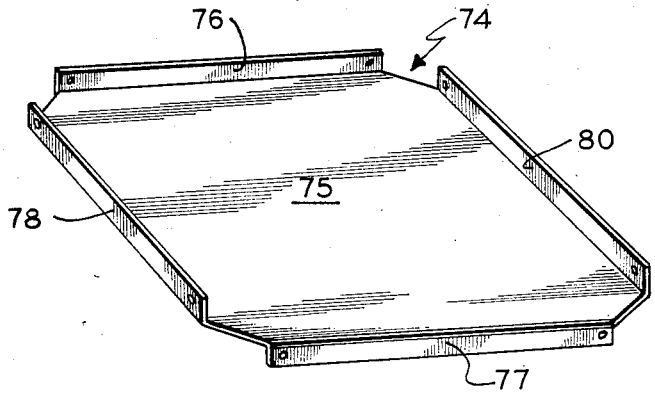
FIG. 12 is a perspective view of one of the shelves.

As seen in section in FIG. 10, a floor 74 composed of a rectangular piece of sheet metal is provided at the bottom of the cabinet. The floor includes four upwardly extending edge flanges, one positioned along each of the mutually perpendicular pairs of side, front and rear edges of the bottom wall 74. In a manner similar to that already described in connection with the shelves of FIGS. 9 and 12, the floor member 74 is retained in place by means of any suitable removable fastener such as screw fasteners of any kind desired. It can be seen that the floor 74 is thus the same as the shelves 75 except for the front flange 77 which is bent upwardly rather than downwardly as shown in FIGS. 9 and 12.

Figure 13:
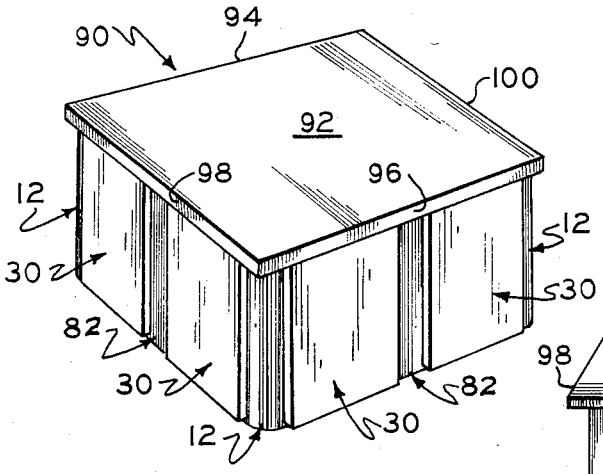
FIG. 13 is a perspective view of another form of cabinet.
Figure 14:
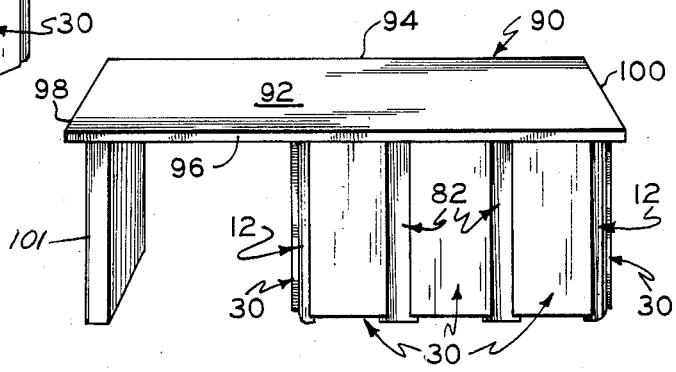
FIG. 14 is a perspective view of yet another form of cabinet.

FIG. 13 shows another form of cabinet embodying the invention which in this case consists of four corner columns 12, four T-columns 82 & eight panels 30. The cabinet top 92 is the same as already described in connection with FIGS. 8 and 10 except that it is wider. Another form of the invention is shown in FIG. 14. In this case, three front panels 30 are positioned in coplanar alignment and are mounted between T-columns 82 and corner columns 12. Three similar panels 30 (not shown) are provided at the rear of the cabinet to form the rear wall. Another pair of panels 30 are connected between the columns 12 and the rear portion of the cabinet thereby extending from the front wall closest to the observer toward the rear of the cabinet. The table-top 90 in this case extends toward the left beyond the panels and columns and is provided with a supporting leg 101 of any suitable known construction. The cabinet in this case can thus be used as a work table with a chair drawn up underneath it.

Accordingly, from the figures it will be seen that the present invention provides a modular cabinet unit that comprises a self-supporting framework of identical and interchangable vertical column members, identical and interchangable box panels defining planar surfaces of the assembled furniture and being assembled in various different relationships to provide cabinets of different sizes and shapes from the same component parts. It will also be seen that the cabinets can be disassembled if and when desired and successfully reassembled. They can also be shipped in a knocked down condition to save space. The box structure of the side panels increases the strength and rigidity of the cabinet which is important when it is used for supporting machine tools as well as hiding the fasteners 66, 68 so that they cannot be seen from the outside. The webs 62, 64 of the columns after assembly include coplanar pairs of webs defining projected side panel mounting planes extending between them. The side panels 30 are thus mounted upon the coplanar webs of the adjacent columns. The strength of the box panels is transmitted reliably to the columns 12 and 82 by the face-to-face lapped relationship of the tabs 46, 48 and the underlying web portion of the columns.

While the invention has been described by way of example, many variations are possible within the scope of the appended claims that will be apparent to those skilled in the art once the principles of the invention are understood.

What is claimed is:

1. A modular metal cabinet having hidden fasteners and comprising, a plurality of vertical interchangeable upright spatially separated unitary support columns each formed from an upright column section composed of a single piece of sheet metal and consisting of a pair of opposing web portions positioned at right angles to one another at each edge thereof, said web portion defining intersection panel mounting planes and a central quarter round section extending between the web portions and being positioned inwardly from each intersection between the panel mounting planes containing the webs, and each column being oriented with its central quarter round section projecting outwardly, each cabinet including at least four of said spatially separated columns forming the corners of the cabinet, the webs of the columns having coplanar pairs of webs defining said mounting planes which extend between the columns, a plurality of identical interchangeable hollow reinforcing box panels formed from sheet metal comprising stationary side panels, each box panel is composed of a central wall section of rectangular shape, parallel top and bottom walls extending centrally from upper and lower edges of the central section, parallel vertically disposed side walls extending centrally from side edges of the central wall section, with coplanar tabs extending toward one another from the inward edges of the side walls the tabs of the panels being positioned in said panel mounting planes in abutting face-to-face relationship with the webs of the columns, said panels thereby projecting outwardly from the panel mounting plane whereby the columns are recessed inwardly from the central wall section of the panels by virtue of the box panels being mounted with said tabs in said mounting planes and said panels projecting outwardly therefrom whereby the central wall, side walls and tabs of the panels intersect to form a rigid structure to protect the columns, mounting means on the panels and on the columns in which the mounting means comprises a face-to-face abutment of the tabs and underlying outer surface of the web portions of the columns along the edges of the columns and along the inner surface of the tab members for establishing as a sole means of maintaining selected relationship of the panel members and the vertical column members to each other, the web portions and tabs being formed with a like number of vertically spaced openings with fasteners received therein, said fasteners each including portions protruding through the web and the tab to hold the tabs in face-to-face contact with the webs, whereby the box structure of the panels connecting the columns to one another strengthens and rigidifies the cabinet and whereby the fasteners are hidden within the box panels.

2. The cabinet of claim 1 wherein mounting plates are secured to the upper ends of the columns and a tabletop is fastened to the mounting plates.

3. The cabinet of claim 2 wherein the mounting plates comprise sheet metal plates rigidly secured in coplanar relationship to the upper ends of the columns and releasable screw fasteners secure the tabletop to the mounting plates.

4. The cabinet of claim 1 wherein the columns include at least one pair of vertically disposed intermediate flat columns having a flat outer surface including a pair of webs positioned in the same plane whereby after assembly the adjacent panels connected to the intermediate flat column are aligned in the same plane to provide a modular cabinet having at least two pairs of adjacent box panels forming the wall of the cabinet including said box panels in side-by-side relationship.

* * * * *